US010542352B2

(12) United States Patent
Karlsen et al.

(10) Patent No.: US 10,542,352 B2
(45) Date of Patent: Jan. 21, 2020

(54) HEARING AID DEVICE UNIT ALONG A SINGLE CURVED AXIS

(71) Applicant: Oticon Medical A/S, Smørum (DK)

(72) Inventors: Morten Friis Karlsen, Smørum (DK); Claus Tipsmark, Smørum (DK)

(73) Assignee: OTICON MEDICAL A/S, Smørum (DK)

( * ) Notice: Subject to any disclaimer, the term of this patent is extended or adjusted under 35 U.S.C. 154(b) by 0 days.

(21) Appl. No.: 15/986,060

(22) Filed: May 22, 2018

(65) Prior Publication Data

US 2018/0343525 A1 Nov. 29, 2018

(30) Foreign Application Priority Data

May 23, 2017 (EP) ..... 17172515

(51) Int. Cl.
*H04R 25/00* (2006.01)
*H04R 25/02* (2006.01)

(52) U.S. Cl.
CPC ..... *H04R 25/02* (2013.01); *H04R 2225/021* (2013.01)

(58) Field of Classification Search
CPC .. H04R 25/02; H04R 25/65; H04R 2225/021; H04R 2225/63; H04R 25/554; H04R 25/558; H04R 25/60; H04R 25/602
USPC ..... 381/327, 330, 232
See application file for complete search history.

(56) References Cited

U.S. PATENT DOCUMENTS 4,207,441 A 6/1980 Ricard et al.
4,532,930 A 8/1985 Crosby et al.
6,546,110 B1 * 4/2003 Vonlanthen ..... H04R 25/556 381/314
6,549,634 B1 * 4/2003 Vonlanthen ..... H04R 25/48 381/322
6,625,290 B1 * 9/2003 Dittli ..... H04R 25/60 381/322
6,731,770 B1 * 5/2004 Vonlanthen ..... H04R 25/556 381/314
6,735,319 B1 * 5/2004 Vonlanthen ..... H04R 25/60 381/322

(Continued)

FOREIGN PATENT DOCUMENTS

DE 3032311 A1 * 3/1981 ..... H04R 25/554
DE 11 2005 003 189 T5 11/2007

(Continued)

*Primary Examiner* — Binh Kien Tieu
(74) *Attorney, Agent, or Firm* — Birch, Stewart, Kolasch & Birch, LLP

(57) ABSTRACT

According to an embodiment, a behind-the-ear (BTE) hearing aid unit is disclosed. The unit includes a housing comprising a hollow inner section defined by an enclosed wall surface made of a single inseparable unit, an electronic module, and an ear hook that is permanently or detachably attached to the housing. The housing extends completely along a single curved axis running along the enclosed wall surface from a first end of the housing comprising the ear hook and a second end of the housing opposite to the ear hook. The housing comprises an inlet opening at the second end, wherein the inlet opening is adapted to receive the electronic module in the hollow inner section and the electronic module is adapted to move from the inlet opening along the single curved axis.

19 Claims, 8 Drawing Sheets

(56) References Cited

U.S. PATENT DOCUMENTS 6,831,988 B2 * 12/2004 Vonlanthen ..... H04R 25/556 381/314
7,099,484 B2 * 8/2006 Vonlanthen ..... H04R 25/48 381/322
7,142,926 B2 * 11/2006 Crawford ..... H04R 25/606 607/55
8,437,860 B1 5/2013 Crawford et al.
2002/0106096 A1 * 8/2002 Vonlanthen ..... H04R 25/48 381/330
2002/0131614 A1 * 9/2002 Jakob ..... H04R 25/552 381/314
2003/0156727 A1 * 8/2003 Vonlanthen ..... H04R 25/556 381/330
2004/0044389 A1 * 3/2004 Crawford ..... H04R 25/606 607/116
2004/0151331 A1 * 8/2004 Vonlanthen ..... H04R 25/556 381/315
2005/0041826 A1 * 2/2005 Dittli ..... H04R 25/60 381/322
2006/0126875 A1 * 6/2006 Kragelund ..... H04R 25/60 381/327
2008/0205680 A1 8/2008 Ho et al.
2011/0211716 A1 9/2011 Cheng et al.
2011/0268304 A1 * 11/2011 Ang ..... H04R 25/02 381/330
2016/0360333 A1 * 12/2016 Higgins ..... H04R 1/04
2017/0180885 A1 * 6/2017 Meskens ..... A61N 1/08
2019/0131046 A1 * 5/2019 Young ..... H01F 7/0205

FOREIGN PATENT DOCUMENTS

EP 0806885 A1 * 11/1997 ..... H04R 25/556
EP 3 267 696 A1 11/2007
WO WO-0079835 A1 * 12/2000 ..... H04R 25/48
WO WO-0251203 A1 * 6/2002 ..... H04R 25/556
WO WO 2010/068177 A1 6/2010

* cited by examiner

HEARING AID DEVICE UNIT ALONG A SINGLE CURVED AXIS

FIELD

The disclosure relates to a hearing aid. In particular, the disclosure relates to a behind-the-ear (BTE) hearing aid unit, which may be a sound processor for a cochlear implant. The BTE hearing aid unit includes a housing comprising a hollow inner section extending completely along a single curved axis and made of a single inseparable unit.

BACKGROUND

Medical electronic devices have become indispensable. Such devices include a hearing aid as well. A hearing aid is a device for aiding an individual in regard to his or her hearing. It is generally used to compensate a hearing loss, namely a conventional acoustic hearing aid amplifying sound, or a cochlear implant that electrically stimulates nerve cells or a bone conduction hearing aid. It may also be a hearing protection device which helps individuals to hear without damage in noisy environments. It may also be a tinnitus treatment device.

BTE hearing aid units such as traditional BTE hearing aids comprise a partially longitudinal, hook-shaped shell running substantially along a longitudinal axis and containing electronic components within the shell. One shell end, usually the tapering end, constitutes the ear hook that is used to rest the hearing aid unit on and behind a user's ear. Generally, the shell is made of two lengthwise parts that are joined together to form the shell. The electronic components are placed on top of inner surface of one of the parts before the two parts are joined together. This type of shell suffers from a number of drawbacks:

i) because the shell includes two parts, the shell may be weaker along the line where two parts are joined together and thus susceptible to breakage;

ii) additional sealing material is required along the line where the two parts join.

However, despite the sealing provided along the line where the two parts are joined together, the shell is vulnerable to dirt and liquid including user's sweat entering the shell along the line because parting lines of this nature are very difficult to seal. Ingress of liquid inside the shell may even lead to corrosion of electronic components and possibility of a short circuit, and iii) the assembly of the electronic components need to precise in order to reliably join the two parts together.

The disclosure proposes a solution that overcomes the aforementioned drawbacks.

SUMMARY OF THE INVENTION

According to an embodiment, a behind-the-ear (BTE) hearing aid unit is disclosed. The unit includes a housing comprising a hollow inner section defined by an enclosed wall surface made of a single inseparable unit, an electronic module, and an ear hook that is permanently or detachably attached to the housing. The housing extends completely along a single curved axis running along the enclosed wall surface from a first end of the housing comprising the ear hook and a second end of the housing opposite to the ear hook. The housing comprises an inlet opening at the second end, wherein the inlet opening is adapted to receive the electronic module in the hollow inner section and the electronic module is adapted to move from the inlet opening along the single curved axis.

The single inseparable unit is devoid of any parting lines or segments between enclosed wall surface that forms the hollow inner section. This means that the hollow inner section defining a shell cannot be opened up in separate pieces, i.e. the housing is adapted to avoid being opened in separate pieces. This allows for avoiding access to the hollow inner section along the wall surface. As the wall surface does not include any provision for providing access to the hollow inner section, the protection of the electronic module/hollow inner section against dirt, sweat, humidity, water, etc. is significantly and mechanical strength of the hearing aid unit is increased. This may be particularly useful because the wall surface is typically exposed to and facing either user skin or environment during usage of a BTE hearing aid unit.

In an embodiment, the single curved axis may be defined by an arc such as a rotational axis. A center point around which the rotation axis is made may define the single curved axis. The arc may include i) a circular arc or a substantially circular arc. These arc may be understood as an arc of a segment of a circle or a substantial circular shape respectively, or ii) a parabolic arc, which may be understood as a segment of a parabolic arc. Thus, the curve axis is a rotational axis along which the electronic module is adapted to rotate during insertion of the electronic module into the hollow inner section. In an embodiment, the rotational axis may be adapted to substantially match curvature of a depression behind outer ear next to the head, i.e. auricular sulcus of the user. In another embodiment, the rotational axis may be adapted to substantially match a curvature of depression behind outer ear next to the head, i.e. auricular sulcus of at least 50% of a sample population.

Having the housing extending completely along a single curved axis is useful because an inner curvature, which is adapted to abut the user's ear, of the enclosed wall surface is likely to provide a better compliance with the behind-the-ear periphery of the user's ear. This allows for the hearing aid unit resting over a user's ear in more comfortable and reliable manner. According to an embodiment, the electronic module is fabricated on a chassis extending along a chassis axis that resembles the single curved axis. The term resembles indicate that the chassis axis and the single curved axis are at least substantially same. This allows the electronic module to move freely in a swift motion along the rotational axis within the hollow inner section from the inlet opening along the single curved axis during assembly. This is particularly useful in comparison to shells that include a combination of longitudinal axis and curved axis, where referred free movement of chassis is not possible, thus requiring a longer time and more complicated procedures during assembly. Additionally, the length of the electronic module may be matched with length of the hollow inner section, the length being along the single curved axis.

The electronic module includes at least a processor, which is adapted to process an incoming signal that is used to compensate for the hearing loss of the user. Additionally, the electronic module may further include a microphone, which is adapted to receive a sound and generating the incoming signal that is provided to the processor. In one embodiment, the electronic module may include and electro-mechanical transducer such as a speaker. In another embodiment, the electronic module includes a memory and/or a number of connectors for example, a connector for a cable of a cochlear implant connecting the BTE hearing aid unit (e.g. sound processor) to an antenna, and/or multi-connector for connecting the processor with other devices like hearing aid programming system or a battery module or other attachment modules. In yet another embodiment, the electronic module may include power management unit including battery and connection between the battery and other electronic components such as processor. In other embodiments, electronic components like T-coil that are generally included in known hearing aid may also be included in the housing.

The second end may be understood as a base end of the BTE hearing aid unit, the base end being devoid of a connection to the ear hook.

According to an embodiment, the BTE hearing aid unit includes a closing structure at the first end of the housing, the closing structure being part of the single inseparable unit. Thus, the closing structure is an integral part of the single inseparable unit without any parting lines either at the closing structure or at the interface between the closing structure and the enclosed wall surface. This allows for avoiding access to the hollow inner section from the closing structure or the interface and protecting of the electronic module/hollow inner section against dirt, sweat, humidity, water, etc, and additionally also provides mechanical strength.

According to an embodiment, the closing structure or ear hook comprises a protruded part and another of the closing structure or ear hook comprises a receiving section. The protruded part and the receiving section are configured to couple with each other such that the ear hook and the housing are immovable in lateral directions relative to each other. The lateral directions comprise direction sideways with respect to extrapolated axis, extending outwards from the first end, of the single curved axis. In one embodiment, the protruded part and the receiving part includes threads that are adapted to cooperate with one to allow screwing of the ear hook to the housing. In another embodiment, the coupling of the protruded part and the receiving section are configured to align a through-going hole of the ear hook and a through-going hole of the housing such that the aligned through-going holes are configured to receive an attachment unit that is adapted to immovably attach the detachably attached ear hook to the housing. The attachment unit such as a pin may be configured to go either partially or completely through combined width of the protruded part and the receiving section.

Hereby, it is possible to provide a reliable and simple mechanical way of fixing the ear hook to the housing.

According to an embodiment, a hearing aid is disclosed. The hearing aid includes a housing adapted to house the electronic module. The hearing aid housing further comprises an ear hook and a structure at the hook end of the housing. The structure and the ear hook includes features disclosed hereinabove with respect to the closing structure and ear hook respectively, i.e. structure or ear hook comprises a protruded part and another of the closing structure or ear hook comprises a receiving section, the protruded part and the receiving section being configured to couple with each other such that the ear hook and the housing are immovable in lateral directions relative to each other. In a further embodiment, the coupling of the protruded part and the receiving section is configured to align a through-going hole of the ear hook and a through-going hole of the housing such that the aligned through-going holes are configured to receive an attachment unit to immovably attach the detachably attached ear hook to the housing. Although it may be useful for the housing comprising a hollow inner section extending completely along a single curved axis and made of a single inseparable unit but in this embodiment, the housing may not necessarily include a single inseparable unit extending completely along a single curved axis.

According to an embodiment, the BTE hearing aid unit includes a cover adapted to sealably close the hollow inner section at the second end, i.e. closing the inlet opening. The cover may be molded with the housing during the assembly. The cover includes a first set of connectors such as electrical slots and guide channels. The first set of connectors i) is adapted to establish electrical connection with the electronic module and ii) comprises one end that is accessible from outside the hollow inner section. The guide channel is configured to receive an attachable module comprising a second set of connectors such as electrical pins and an interacting means adapted to run along the guide channel to establish a mechanical connection between the housing and the attachable module and an electrical connection between the one end of the first set of connectors and second set of connectors.

In an embodiment, the BTE hearing aid unit and the attachable module may include an alignment structure in order to align the one end of the first set of connectors and second set of connectors. In an embodiment, the BTE hearing aid unit and the attachable module are adapted to be locked using a locking mechanism.

In different embodiments, the attachable module may include a battery compartment, or fm receiver or programming interface or any other module that provides additional functionality to the hearing aid unit.

The sliding mechanism to establish mechanical and electrical connection is disclosed in FIG. 2 (disclosing generally a sliding mechanism) and description of FIG. 2 along with related text in the Summary section, FIG. 6 (disclosing details of the guide channels, which may be present at both the BTE hearing aid unit and attachable module) and description of FIG. 6 along with related text in the Summary section, 7 (disclosing alignment structure), and FIG. 9 (disclosing details of the guide channel and the interacting means) and description of FIG. 9 along with related text in the Summary section of the pending EP application EP16178631, which is incorporated herein by reference. Also, the locking mechanism of the BTE hearing aid unit (first functional unit) and attachable module (second functional module) is disclosed in FIG. 3 (locking mechanism comprising a moveable unit) and description of FIG. 3 along with related text in the Summary section, FIG. 4 (disclosing a friction element) and description of FIG. 4 along with related text in the Summary section, FIG. 5 (disclosing a stop member) and description of FIG. 5 along with related text in the Summary section of the pending EP application EP16178631, which is incorporated herein by reference. Furthermore, battery compartment as a detachable second functional unit is disclosed in FIGS. 1 and 2 and description of these figures along with related text in the Summary section of the pending EP application EP16178631, which is incorporated herein by reference. The referred EP application is titled "Hearing aid comprising a locking mechanism" with Oticon Medical A/S as the applicant. Incorporation of content of pending EP application EP16178631 and protection of features disclosed in the pending EP application in combination with one or more embodiments of the embodiments disclosed in this application is intended. Such combination would allow for mechanically and electrically connecting the hearing aid unit with the attachment module in a secure manner and also for extending the functionalities of the hearing aid unit.

According to an embodiment, the BTE hearing aid unit includes a microphone inlet cover adapted to attach to the housing to form a continuous concave shaped outer surface with the housing. The microphone inlet cover and the housing may include attachment means such as snap locking mechanism. The microphone inlet cover in cooperation with the housing exterior surface is adapted to form sound inlet channel adapted to allow ambient sound to travel from an entry of the sound inlet channel to an inlet port of a microphone that is comprised within the hollow inner section. The entry of the sound inlet channel is from side surface of the enclosed wall surface.

In one embodiment, the sound inlet channel may be adapted by varying dimensions of the sound inlet channel in order to avoid turbulent flow of air flowing at least in a part of the sound inlet channel. In an embodiment, the sound inlet channel comprising a volumetric chamber at least directly above the microphone, preferably above the inlet. The dimensions of the volumetric chamber are adapted to bring pressure and/or flow velocity of air flowing within the volumetric chamber substantially close to zero. The volumetric chamber is defined by a cut out section at the inner surface of the microphone inlet cover that is adapted to be at least directly above the microphone, preferably above the inlet. The cut out section in combination with the sound inlet channel that is at least directly above the microphone, preferably above the inlet forms a cross sectional area that is substantially larger than cross sectional area of rest of the sound inlet channel. The cross-sectional area refers to cross sectional area, as viewed from at least one a first direction and a second direction, the first direction and the second direction being orthogonal to each other. This allows for avoiding turbulent flow within the volumetric chamber and reducing the wind noise. According to another embodiment, dimensions of sound inlet channel the sound inlet channel is adapted to optimize wind noise suppression with respect to acoustic attenuation. Such optimization would result in an improved intelligibility of the signal. In both embodiments, the dimensions may include length of the channel from the entry of the sound inlet channel to the inlet port and/or cross-sectional dimensions of the sound inlet channel.

In an embodiment, the inlet channel includes capillary stop to minimize liquid ingress into microphones. In an embodiment, the inlet channel includes a wall barrier comprising a height that is lower than height of the inlet channel at the location where the wall barrier is positioned. The wall barrier runs along a substantial length of the entry of the sound inlet channel, i.e. along the single curved axis. The wall barrier is typically positioned such that a distance between the wall barrier and the entry of the sound inlet channel inlet is smaller than the distance between the barrier wall and the inlet port of the microphone. The referred distance is measured along the channel path, i.e. the path that sound/air follows to travel from the entry to inlet port of the microphone. The barrier wall allows for preventing ingress of moisture, grease, dirt, water, etc.

According to an embodiment, the BTE hearing aid unit includes an alignment pin comprising a first end configured to be received within a receiving hole across the housing and comprised at a chassis holding the microphone, the chassis being positioned within the housing and the alignment pin being adapted to align the microphone with respect to an inlet and housing. The chassis may also provide a support for a circuit board to which the microphone is connected. As the alignment pin is configured to go only in the receiving hole of the chassis, the chassis is positioned precisely in the housing and the microphone(s) are thus properly aligned with the inlet. This is particularly useful so that the liquid/dust tight seal may be created between the inlet and housing. In an embodiment, the alignment pin further includes a second end configured to be received within a recess at an inner surface of the microphone inlet cover. The alignment pin thus also adapted to provide an aligned position of the microphone inlet cover over the housing exterior surface, thereby creating desired inlet channels. The inner surface of the microphone inlet cover and the exterior surface of the housing cooperating with the microphone inlet cover are adapted to be concealed when the microphone inlet cover is in position. In the combinable embodiments recited in this paragraph, the alignment pin is typically positioned substantially perpendicular to the single curve axis.

According to an embodiment, the BTE hearing aid unit includes an inlet aligned to the inlet port of the microphone. The inlet is attached to the housing with a sealing material interposed between the inlet and side surface of the housing. The sealing material provides a seal between the sound inlet channel and hollow inner shell. Thus, the sound can travel to the electronic module by entering from the entry of the sound inlet channel, travelling through the sound inlet channel, entering the inlet and finally entering the microphone from the inlet port of the microphone.

According to an embodiment, a hearing aid is disclosed. The hearing aid includes a housing adapted to house the electronic module. The hearing aid housing may further include an ear hook. In addition, the hearing aid includes a microphone inlet cover adapted to attach to the housing to form a continuous concave shaped outer surface with the housing, the microphone inlet cover in cooperation with the housing exterior surface is adapted to form sound inlet channel adapted to allow ambient sound to travel from an entry of the sound inlet channel to an inlet port of a microphone that is comprised within the hollow inner section. Additionally, the hearing aid may include an alignment pin comprising a first end configured to be received within a receiving hole across the housing and comprised at a chassis holding the microphone, the chassis being positioned within the housing and the alignment pin being adapted to align the microphone with respect to an inlet and housing. Additionally, the alignment pin further includes a second end configured to be received within a recess at an inner surface of the microphone inlet cover. In an embodiment, the hearing aid also includes an inlet aligned to the inlet port of the microphone, the inlet being attached to the housing with a sealing material interposed between the inlet and side surface of the housing. The hearing aid may further include features relating to positioning of microphone inlet cover that are described above in earlier embodiments. In another embodiment, the hearing aid further includes the volumetric chamber as disclosed previously. Although it may be useful for the housing comprising a hollow inner section extending completely along a single curved axis and made of a single inseparable unit but in this embodiment, the housing may not necessarily include a single inseparable unit extending completely along a single curved axis.

According to an embodiment, the housing exterior surface comprises a push button slot comprising at least one slot to receive at least one push actuator and a fixing means slot. In an embodiment, the fixing means slot extends beyond the curved concave exterior surface of the housing.

According to an embodiment, the at least one push actuator is adapted to be fixedly positioned within the at least one slot with a sealing material interposed between the push actuator and side surface of the push button slot. The interposed sealing material is adapted to seal the hollow inner section against dirt, dust or sweat, etc.

According to an embodiment, the BTE hearing aid unit includes a push button cover and a fixing means. The push button cover is adapted to cover the at least one push actuator. The fixing means is adapted to pass through the push button cover and to be received within the fixing means slot in order to attach the push button cover with the housing.

In one embodiment, the fixing means include a pin adapted to pass through the push button cover and the fixing means slot include adjacent walls positioned within the push button slot, the adjacent walls being configured to receive the pin and lock the pin by snapping length of the pin between the adjacent walls. In another embodiment, the fixing means include a pin and the fixing means slot include a tunnel running, at least partially, across the push button slot. The push button cover includes holes on both sides of cover wall, wherein the holes are configured to align with the tunnel such that the pin is adapted to pass through the holes and tunnel in order to provide attachment between the push button cover and the housing.

The push button may be programmed to perform different functions. For example, the push button may be used to one or more of many tasks change volume, change program, put the hearing aid in different functional mode or any other function that is generally known in the art.

According to an embodiment, a hearing aid is disclosed. The hearing aid includes a housing adapted to house the electronic module. The hearing aid housing may further include an ear hook. In an embodiment, the housing exterior surface comprises a push button slot comprising at least one slot to receive at least one push actuator and a fixing means slot. In another embodiment, at least one push actuator is adapted to be fixedly positioned within the at least one slot with a sealing material interposed between the push actuator and side surface of the push button slot. In another embodiment, a push button cover adapted to cover the at least one push actuator; and a fixing means adapted to pass through the push button cover and to be received within the fixing means slot in order to attach the push button cover with the housing. The hearing aid may further include features relating to the push button and its arrangement over the housing that are described above in earlier embodiments. Although it may be useful for the housing comprising a hollow inner section extending completely along a single curved axis and made of a single inseparable unit but in this embodiment, the housing may not necessarily include a single inseparable unit extending completely along a single curved axis.

According to an embodiment, the BTE hearing aid unit includes a plug port across the housing. The plug port is adapted to receive a cable into the housing and provide the cable access to a connector socket (such as T2 socket) that is adapted to provide electrical connection between the electronic module and cable. In an embodiment, the cable received within the housing has its first end electrically connected to the electronic module and second end connected to an antenna for example like in cochlear implant system. Thus the processed audio signal, using the cable, is transmitted from the BTE hearing aid unit to the antenna.

In one embodiment, the entire connector socket is positioned inside the housing such that the cable is received within the housing with cable strain relief partially received within the housing and substantially protruding out of the housing.

According to an embodiment, the connector socket is positioned within the housing such that the connector socket is along same longitudinal axis as a multi-connector (such as the first set of connectors as disclosed previously) positioned within the housing, the multi-connector is adapted to provide connection between the electronic module and other auxiliary devices such as the attachment module. As the connectors are lined up along the width of the hearing aid unit, providing the cable connector socket in same longitudinal axis as the multi-connector axis allows for optimally positioning the connectors and utilizing space within the hollow inner section. This, thus allows for reducing the size of the BTE hearing aid unit. The multi-connector may be utilized to electrically connect the hearing aid unit to other devices like attachment module that may including a programming system. In an embodiment, the multi-connector is the first set of connectors adapted to establish electrical connection with the electronic module with one end of the first set of connectors being accessible from outside the hollow inner section. The one end of the first set of connectors accessible from the outside is used to connect the hearing aid device unit with other devices.

The longitudinal axis is typically along the width of the housing along the two curved surface of the shell. Usually, the connector socket is positioned proximal to the plug port whereas the multi-connector is distal from the plug port along the same longitudinal axis.

According to an embodiment, a hearing aid is disclosed. The hearing aid includes a housing adapted to house the electronic module. The hearing aid housing may further include an ear hook. In an embodiment, comprising a plug port across the housing, the plug port being adapted to receive a cable into the housing and provide the cable access to a connector socket that is adapted to provide electrical connection between the electronic module and cable. In another embodiment, the connector socket is positioned within the housing such that the connector socket is along same longitudinal axis as a multi-connector positioned within the housing, the multi-connector is adapted to provide connection between the electronic module and other auxiliary devices. The hearing aid may further include features relating to the plug port, connector socket and multi-connector that are described above in earlier embodiments. Although it may be useful for the housing comprising a hollow inner section extending completely along a single curved axis and made of a single inseparable unit but in this embodiment, the housing may not necessarily include a single inseparable unit extending completely along a single curved axis.

According to an embodiment, the BTE hearing aid unit is a sound processor of a hearing aid such as a cochlear implant system. In another embodiment, the BTE hearing aid unit includes a sound processor for a bone conduction hearing aid. In another embodiment, the BTE hearing aid unit includes sound processor for an acoustic hearing aid.

According to another embodiment, a hearing aid comprising the hearing aid unit described hereinabove in one or more embodiments is included. The hearing aid may include one of a cochlear implant, a bone conduction hearing aid and an acoustic hearing aid.

According to an embodiment, a method for manufacturing the BTE hearing aid unit is disclosed. The method includes preparing a housing comprising a hollow inner section defined by an enclosed wall surface, and preferably with a closing structure at a first end, made of a single inseparable unit and extending completely along a single curved axis, fabricating the electronic module on a chassis extending along a chassis axis resembling the single curved axis, and inserting the chassis through an inlet opening of the housing along the single curved axis, and sealably closing the inlet opening using a cover. The closing structure may include an integrated ear hook or means for detachably attaching the ear hook.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1A:
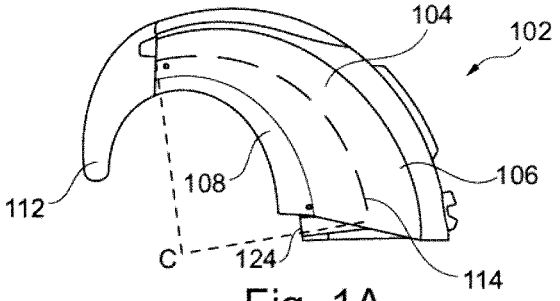
FIG. 1A illustrates side view of a housing extending completely along a single curved axis and made of a single inseparable unit according to an embodiment of the disclosure.
Figure 1B:
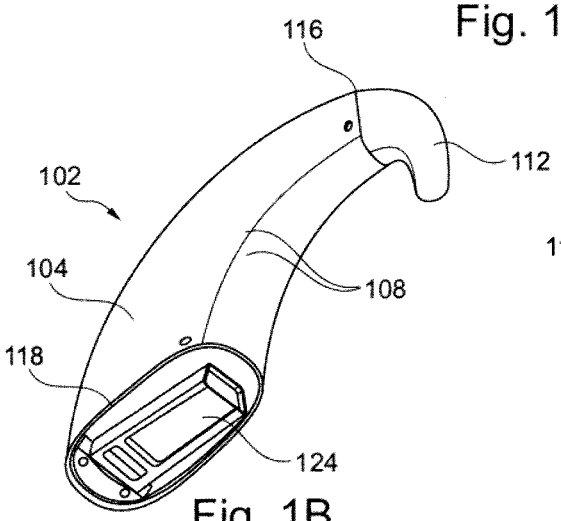
FIG. 1B illustrates a first isometric view of the housing extending completely along a single curved axis and made of a single inseparable unit according to an embodiment of the disclosure.
Figure 1C:
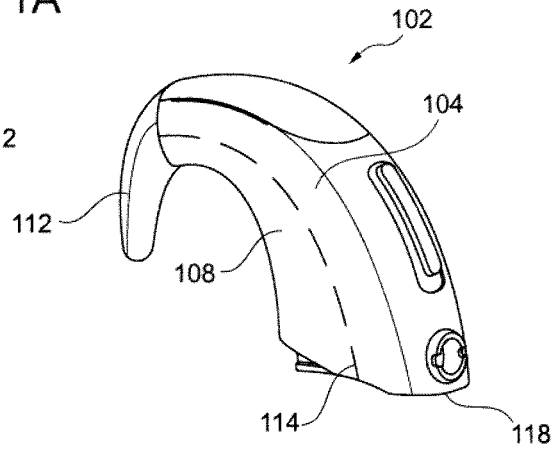
FIG. 1C illustrates a second isometric view of the housing extending completely along a single curved axis and made of a single inseparable unit according to an embodiment of the disclosure.
Figure 1D:
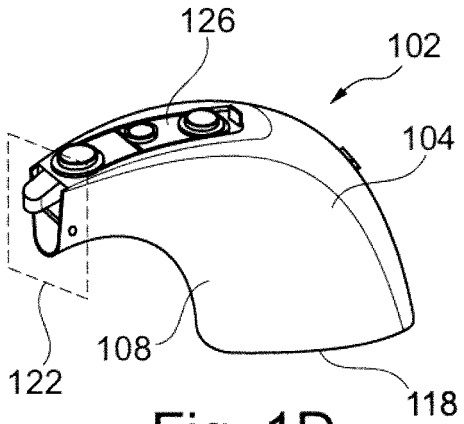
FIG. 1D illustrates the housing extending completely along a single curved axis and made of a single inseparable unit according to an embodiment of the disclosure.

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, etc.

In the description below, same reference numeral generally illustrates the same component of the hearing aid device.

In general, a hearing aid is adapted to improve or augment the hearing capability of a user by receiving an acoustic signal from a user's surroundings, generating a corresponding audio signal, modifying the audio signal and providing the modified audio signal as an audible signal to at least one of the user's ears. The "hearing aid" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

At least a part or entire hearing aid is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid. Such hearing aids include a housing comprising electronic module like a processing unit such as a processor and a permanently attached or detachable ear hook that is adapted to position the hearing aid behind the user's ear or ii) Similar Behind-the-Ear type hearing aid type hearing aid arrangement comprising the housing and ear hook may be used in other stimulation types hearing aids for example as a speech processor unit in a cochlear implant or in bone conduction hearing aid.

The disclosed hearing aid may be part of i) a "hearing system", which refers to a system comprising one or two hearing aids, or ii) a "binaural hearing system", which refers to a system comprising two hearing devices where the devices are adapted to cooperatively provide audible signals to both of the user's ears. In case of the binaural hearing system, the notification may also represent operating state of the system, for example if the connection between the two hearing aids is established or lost. The hearing system or binaural hearing system may further include auxiliary device(s) that communicates with at least one hearing aids, the auxiliary device may affect the operation of the hearing aids and/or benefitting from the functioning of the hearing devices. A wired or wireless communication link between the at least one hearing aid and the auxiliary device may be established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing aid.

In general, the hearing aid includes i) an input unit such as a microphone for receiving an acoustic signal from a user's surroundings and providing a corresponding input audio signal, and/or ii) a receiving unit for electronically receiving an input audio signal. The hearing aid further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant. The Cochlear Implant typically includes i) an external part (speech processor in the housing with a permanently attached or detachable ear hook) for picking up and processing sound from the environment, and for determining sequences of pulses for stimulation of the electrodes in dependence on the current input sound, ii) a (typically wireless, e.g. inductive) communication link for simultaneously transmitting information about the stimulation sequences and for transferring energy to iii) an implanted part allowing the stimulation to be generated and applied to a number of electrodes, which are implantable in different locations of the cochlea allowing a stimulation of different frequencies of the audible range. Such systems are e.g. described in U.S. Pat. No. 4,207,441 and in U.S. Pat. No. 4,532,930.

Referring now to FIG. 1, where FIG. 1A illustrates side view of a housing extending completely along a single curved axis and made of a single inseparable unit according to an embodiment of the disclosure. FIG. 1B illustrates a first isometric view of the housing extending completely along a single curved axis and made of a single inseparable unit according to an embodiment of the disclosure. FIG. 1C illustrates a second isometric view of the housing extending completely along a single curved axis and made of a single inseparable unit according to an embodiment of the disclosure. FIG. 1D illustrates the housing extending completely along a single curved axis and made of a single inseparable unit according to an embodiment of the disclosure. FIG. 1E illustrates the housing extending completely along a single curved axis and made of a single inseparable unit according to an embodiment of the disclosure.

A behind-the-ear (BTE) hearing aid unit 102 includes a housing 104 comprising a hollow inner section (FIG. 1E, 106) defined by an enclosed wall surface 108 made of a single inseparable unit. The unit further includes an electronic module (FIG. 1E, 110); and an ear hook 112 that is permanently or detachably attached to the housing 104. The housing 104 extends completely along a single curved axis 114 running along the enclosed wall surface 108 from a first end 116 of the housing comprising the ear hook 112 and a second end 118 of the housing 104 opposite to the ear hook 112. The housing 104 comprises an inlet opening (FIG. 1E, 120) at the second end 118, the inlet opening 120 being adapted to receive the electronic module (FIG. 1E, 110) in the hollow inner section 106 and the electronic module (FIG. 1E, 110) is adapted to move from the inlet opening (FIG. 1E, 120) along the single curved axis 114. (The lines along the surface from the first end to the second end in FIGS. 1A and 1E only illustrate the curved sections of the housing and should not to be construed as parting lines)

The single curved axis 114 comprises a rotational axis defined by an arc selected from a group comprising a circular arc, substantially circular arc and parabolic arc. The rotational axis may be around a center point C. In other words, the center point C around which the rotation axis is made may define the single curved axis 114.

According to an embodiment, the hearing aid unit 102 further includes a closing structure (FIG. 1D, 122) at the first end 116 of the housing 104. The closing structure 122 is part of the single inseparable unit.

According to an embodiment, the BTE hearing aid unit 102 further includes a cover 124 adapted to sealably close the hollow inner section 106 at the second end 118.

Figure 2:
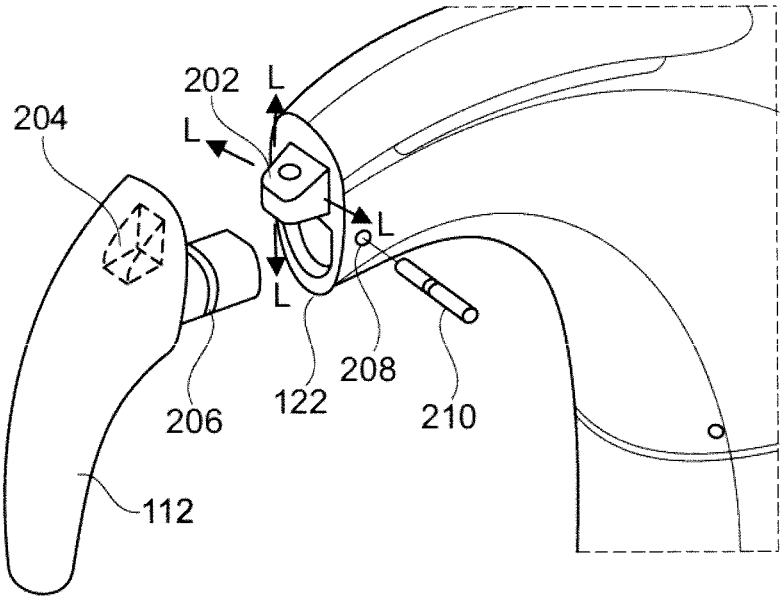
FIG. 2 illustrates an ear hook according to an embodiment of the disclosure.

FIG. 2 illustrates an ear hook according to an embodiment of the disclosure. As illustrated, the closing structure 122 or ear hook 112 comprises a protruded part 202 and another of the closing structure 122 or ear hook 112 comprises a receiving section 204. The protruded part 202 and the receiving section 204 are configured to couple with each other such that the ear hook 112 and the housing 104 are immovable in lateral directions L relative to each other.

According to an embodiment, the coupling of the protruded part 202 and the receiving section 204 is configured to align a through-going hole 206 of the ear hook 112 and a through-going hole 208 of the housing 104 such that the aligned through-going holes (206, 208) are configured to receive an attachment unit 210 to immovably attach the detachably attached ear hook 112 to the housing 104.

Figure 3:
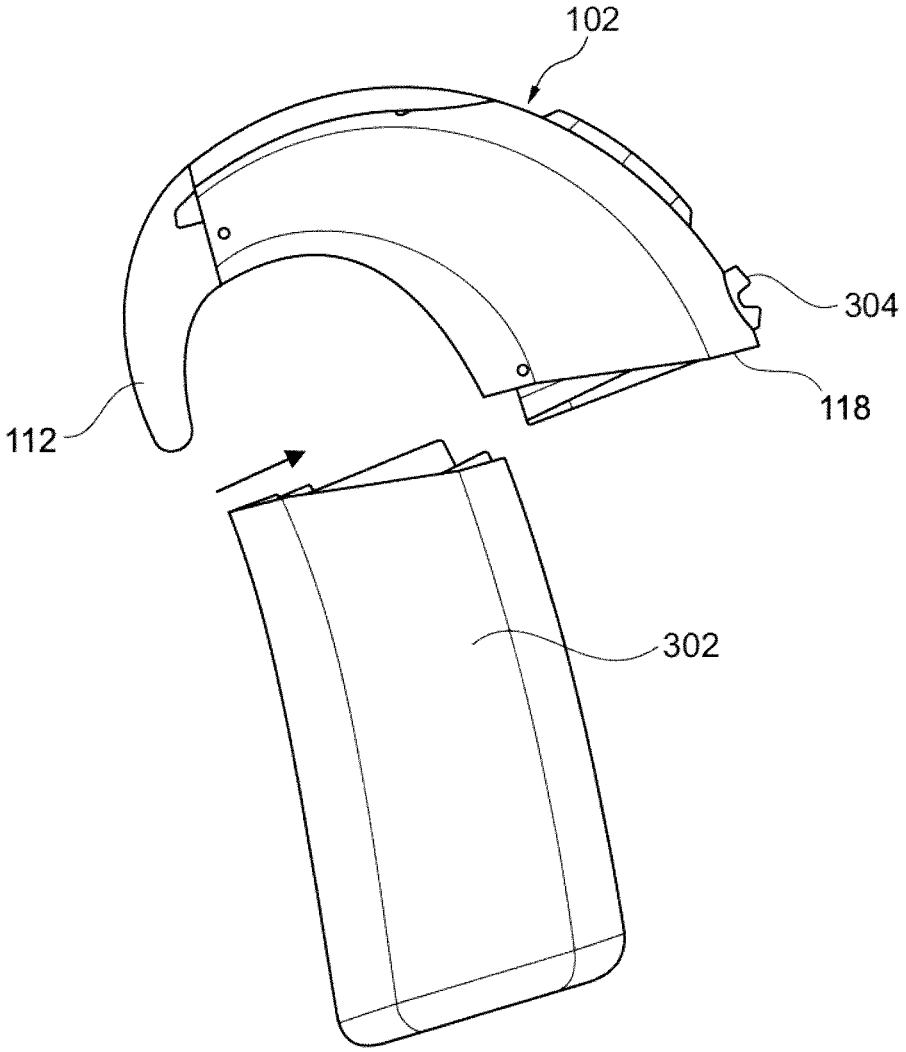
FIG. 3 illustrates the housing and an attachable module according to an embodiment of the disclosure.
Figure 4A:
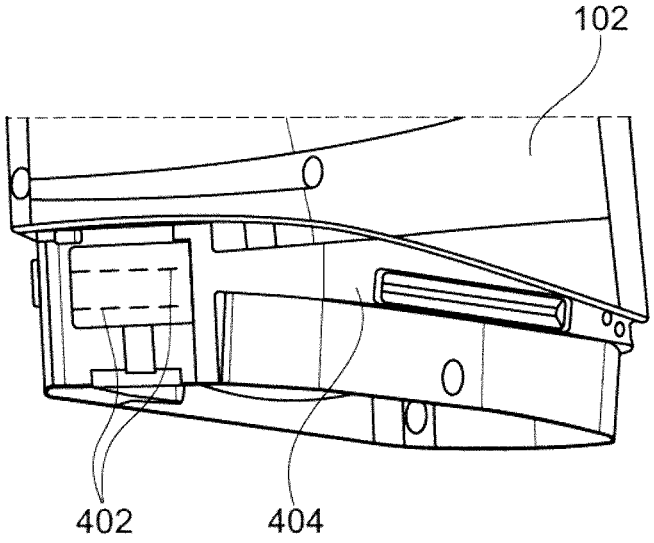
FIG. 4A illustrates a sliding guide rail according to an embodiment of the disclosure.
Figure 4B:
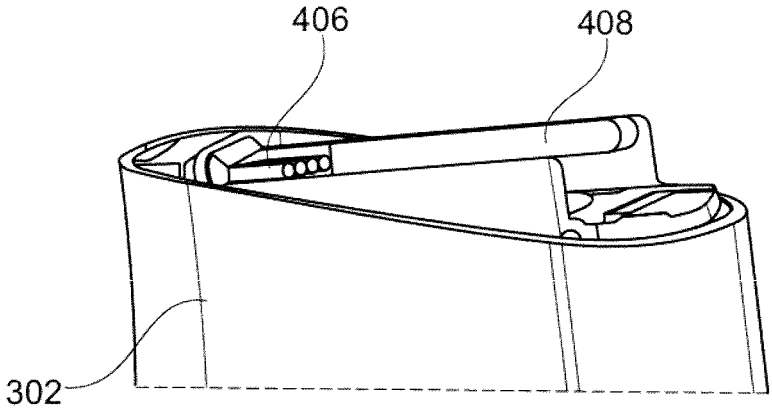
FIG. 4B illustrates an interacting means according to an embodiment of the disclosure.

Now referring to FIGS. 3, 4A and 4B, where FIG. 3 illustrates the housing and an attachable module according to an embodiment of the disclosure. FIG. 4A illustrates a sliding guide rail according to an embodiment of the disclosure. FIG. 4B illustrates an interacting means according to an embodiment of the disclosure.

As mentioned earlier, the BTE hearing aid unit 102 further includes a cover 124 adapted to sealably close the hollow inner section (FIG. 1, 106) at the second end 118. The cover includes a first set of connectors (FIG. 4A, 402) adapted to establish electrical connection with the electronic module (FIG. 1, 110) with one end of the first set of connectors being accessible from outside the hollow inner section (FIG. 4A, 402 represents the one end). The hearing aid unit further includes a sliding guide rail 404 configured to receive an attachable module 302 comprising a second set of connectors 406 and an interacting means 408 adapted to run along the guide rail 404 to establish a mechanical connection between the housing 104 and the attachable module 302 and an electrical connection between the one end 402 of the first set of connectors and second set of connectors 406.

In an embodiment, the BTE hearing aid unit and the attachable module are adapted to be locked using a locking mechanism 304. The locking mechanism may utilize a rotational locking means as disclosed in EP application EP16178631. In an embodiment, the locking means 304 is incorporated with a plug port (FIG. 7A, 702) functionality as disclosed in EP application EP16178631. The locking mechanism of the BTE hearing aid unit (first functional unit) and attachable module (second functional module) is disclosed in FIG. 3 (locking mechanism comprising a moveable unit) and description of FIG. 3 along with related text in the Summary section, FIG. 4 (disclosing a friction element) and description of FIG. 4 along with related text in the Summary section, FIG. 5 (disclosing a stop member) and description of FIG. 5 along with related text in the Summary section of the pending EP application EP16178631, which is incorporated herein by reference.

Figure 5A:
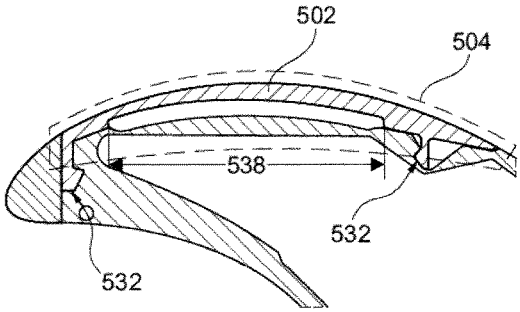
FIG. 5A illustrates a microphone inlet cover according to an embodiment of the disclosure.
Figure 5B:
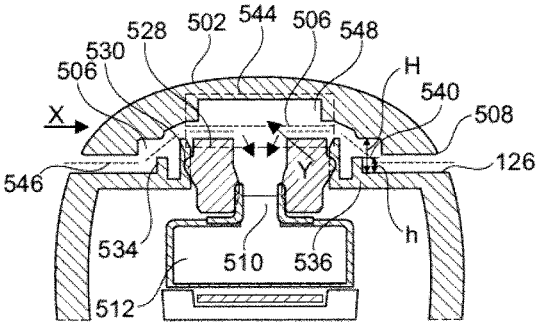
FIG. 5B illustrates a first side view of a microphone assembly comprising a sound inlet channel according to an embodiment of the disclosure.
Figure 5C:
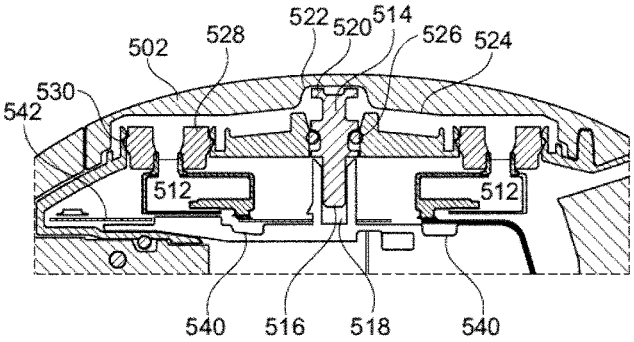
FIG. 5C illustrates a second side view of the microphone assembly according to an embodiment of the disclosure.

Referring to FIG. 5, where FIG. 5A illustrates a microphone inlet cover according to an embodiment of the disclosure; FIG. 5B illustrates a first side view of a microphone assembly comprising a sound inlet channel according to an embodiment of the disclosure and FIG. 5C illustrates a second side view of the microphone assembly according to an embodiment of the disclosure.

According to an embodiment, the BTE hearing aid unit 102 includes a microphone inlet cover 502 adapted to attach to the housing to form a continuous concave shaped 504 outer surface with the housing, the microphone inlet cover 502 in cooperation with a housing exterior surface 126 is adapted to form sound inlet channel 506 adapted to allow ambient sound to travel from an entry 508 of the sound inlet channel 506 to an inlet port 510 of a microphone 512 that is comprised within the hollow inner section.

The microphone inlet cover and the housing may include attachment means 532 such as snap locking mechanism.

According to an embodiment, the BTE hearing aid unit includes an alignment pin 514 comprising a first end 516 is configured to be received within a receiving hole 518 across the housing and comprised at a chassis 540 holding the microphone 512, the chassis 540 being positioned within the housing 104. The chassis 540 may provide a support for a circuit board 542 to which the microphone is connected. The alignment pin 514 is adapted to align the microphone 512 with respect to an inlet 528 and housing 104. As the alignment pin is configured to go only in the receiving hole 518 of the chassis, the chassis 540 is positioned precisely in the housing 104 and the microphone(s) 512 is thus properly aligned with the inlet 528. In an embodiment, the alignment pin 514 further includes a second end 520 configured to be received within a recess 522 at an inner surface 524 of the microphone inlet cover 502. The alignment pin 514 is also adapted to provide an aligned position of the microphone inlet cover 502 over the housing exterior surface 126, thereby creating desired inlet channels. The alignment pin 514 is preferably positioned in the receiving hole 518 with an sealing material 526 sandwiched therebetween to avoid entry of dirt or liquid.

According to an embodiment, the BTE hearing aid unit includes an inlet 528 aligned to the inlet port 510 of the microphone 512. The inlet 528 is attached to the housing 104 with a sealing material 530 interposed between the inlet 528 and side surface of the housing.

In an embodiment, the inlet channel 506 includes a wall barrier 534 comprising a height h that is lower than height F1 of the inlet channel 506 at a location 536 where the wall barrier 534 is positioned. The wall barrier 534 runs along a substantial length 538 of the entry 508 of the sound inlet channel 506, i.e. along the single curved axis (FIG. 1, 114). The wall barrier is typically positioned such that a distance between the wall barrier 534 and the entry 508 of the sound inlet channel 506 is smaller than the distance between the barrier wall 534 and the inlet port 510 of the microphone 512. The referred distance is measured along the channel path, i.e. the path 546 that sound/air follows to travel from the entry 508 to inlet port 510 of the microphone 512.

The microphone is connected to a chassis 540. The chassis 540 may further support a circuit board 542 to which the microphone 512 is electrically connected.

In one embodiment, the sound inlet channel 506 may be adapted by varying dimensions of the sound inlet channel 506 in order to avoid turbulent flow of air flowing at least in a part of the sound inlet channel 506. In an embodiment, a sound inlet channel 506 comprising a volumetric chamber 544 at least directly above the microphone 512, preferably above the inlet 528. The dimensions of the volumetric chamber 544 are adapted to bring pressure and/or flow velocity of air flowing within the volumetric chamber 544 substantially close to zero. The volumetric chamber 544 is defined by a cut out section 548 at the inner surface of the microphone inlet cover 502 that is adapted to be at least directly above the microphone 512, preferably above the inlet 528. The cut out section 548 in combination with the sound inlet channel that is at least directly above the microphone 512, preferably above the inlet 528 forms a cross sectional area that is substantially larger than cross sectional area of rest of the sound inlet channel 506. The cross-sectional area refers to cross sectional area, as viewed from at least one a first direction X and a second direction Y, the first direction X and the second direction Y being orthogonal to each other. This allows for avoiding turbulent flow within the volumetric chamber and reducing the wind noise.

Figure 6A:
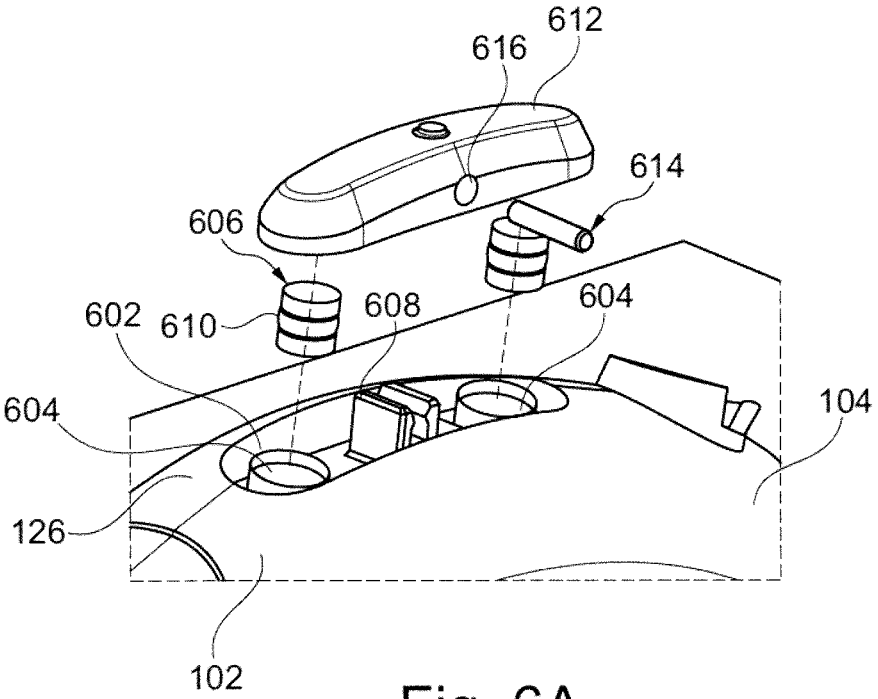
FIG. 6A illustrates a push button assembly according to an embodiment of the disclosure.
Figure 6B:
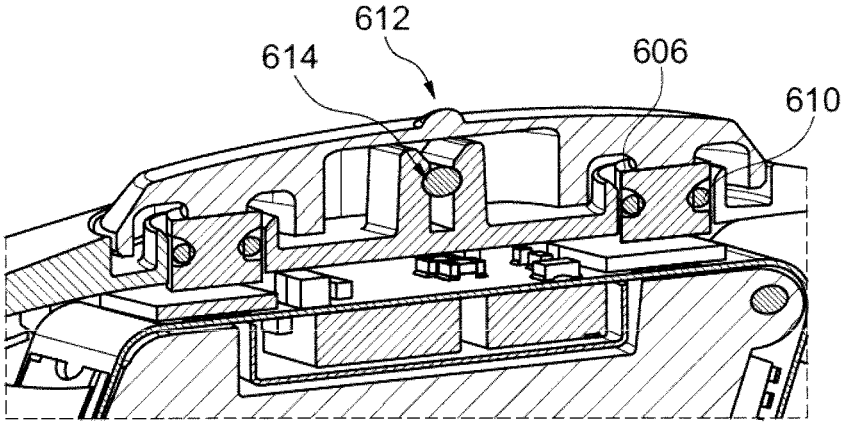
FIG. 6B illustrates a cross-sectional view of the push button assembly according to an embodiment of the disclosure.

FIG. 6A illustrates a push button assembly according to an embodiment of the disclosure. FIG. 6B illustrates a cross-sectional view of the push button assembly according to an embodiment of the disclosure;

According to an embodiment, the housing exterior surface 126 of the housing 104 includes a push button slot 602 includes at least one slot 604 to receive at least one push actuator 606 and a fixing means slot 608. The at least one push actuator 606 is adapted to be fixedly positioned within the at least one slot 604 with a sealing material 610 interposed between the push actuator 606 and side surface of the push button slot 604, as shown in FIG. 6B.

According to an embodiment, the BTE hearing aid unit further includes a push button cover 612 and a fixing means 614. The push button cover 612 is adapted to cover the at least one push actuator 606, and the fixing means 614 is adapted to pass through the push button cover (for example see 616) and to be received within the fixing means slot 608 in order to attach the push button cover 612 with the housing 104.

Figure 7A:
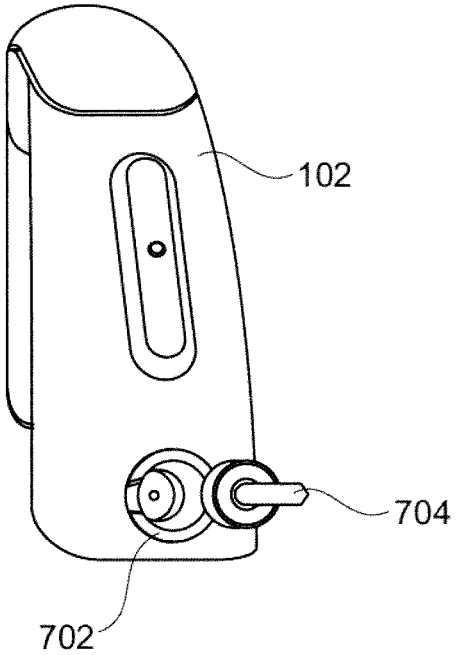
FIG. 7A illustrates a plug port according to an embodiment of the disclosure.
Figure 7B:
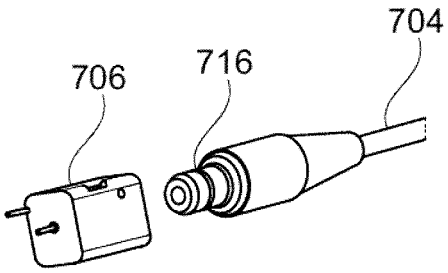
FIG. 7B illustrates a connector socket and cable according to an embodiment of the disclosure.
Figure 7C:
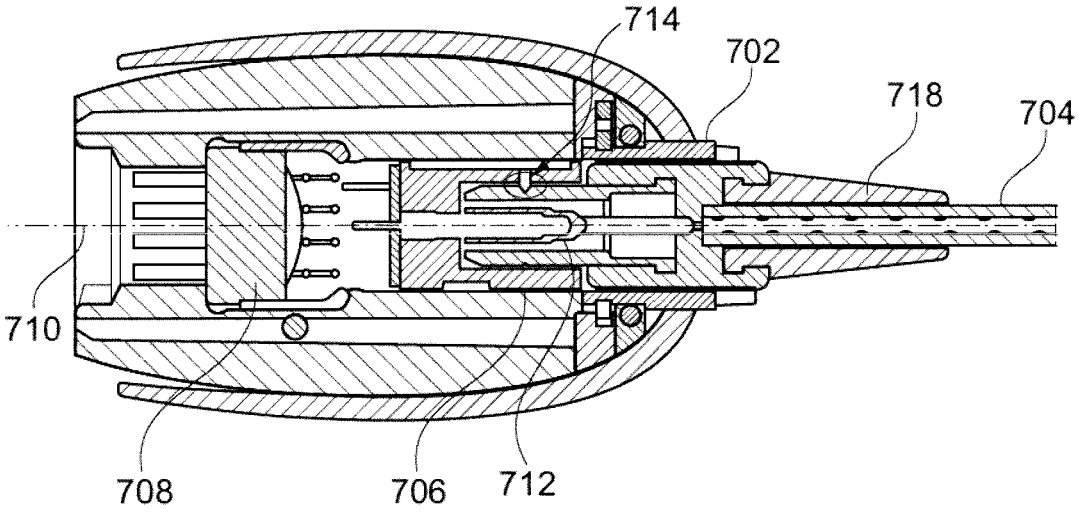
FIG. 7C illustrates a cross-sectional view of plug port, connector socket and multi-connector according to an embodiment of the disclosure.

FIG. 7A illustrates a plug port according to an embodiment of the disclosure; FIG. 7B illustrates a connector socket and cable according to an embodiment of the disclosure; and FIG. 7C illustrates a cross-sectional view of plug port, connector socket and multi-connector according to an embodiment of the disclosure.

According to an embodiment, the BTE hearing aid unit includes a plug port 702 across thickness of the housing 104. The plug port 702 is adapted to receive a cable 704 into the housing 104 and provide the cable 704 access to a connector socket 706 that is adapted to be positioned within the housing and provide electrical connection between the electronic module (FIG. 1E, 110) and cable 704.

According to an embodiment, the BTE hearing aid unit further includes a connector socket 706 that is positioned within the housing 104 such that the connector socket 706 is along same longitudinal axis 710 as a multi-connector 708 positioned within the housing 104. The multi-connector 708 is adapted to provide electrical connection between the electronic module 104 and the attachment module. In an embodiment, the multi-connector 708 is the first set of connectors (FIG. 4A, 402) adapted to establish electrical connection with the electronic module with one end of the first set of connectors being accessible from outside the hollow inner section 106. The one end of the first set of connectors accessible from the outside is used to connect the hearing aid device unit with other devices like battery module or programming system.

The cable may be provided with a first locking means 716 (FIG. 7B) that is adapted to lock with a second locking means 714 (FIG. 7C) of the connector socket 706. The locking, thus provides a reliable mechanical and electrical connection 712 between the cable 704 and connector socket 706. One of the first locking means or second locking means may include a recess while the other of the first locking means or second locking means includes a projection, whereby the projection is adapted to be received in the recess in order to provide a snap locking.

In one embodiment, the entire connector socket 706 is positioned inside the housing 102 such that the cable 706 is received within the housing with cable strain relief 718 partially received within the housing 104 and substantially protruding out of the housing 102.

Figure 8:
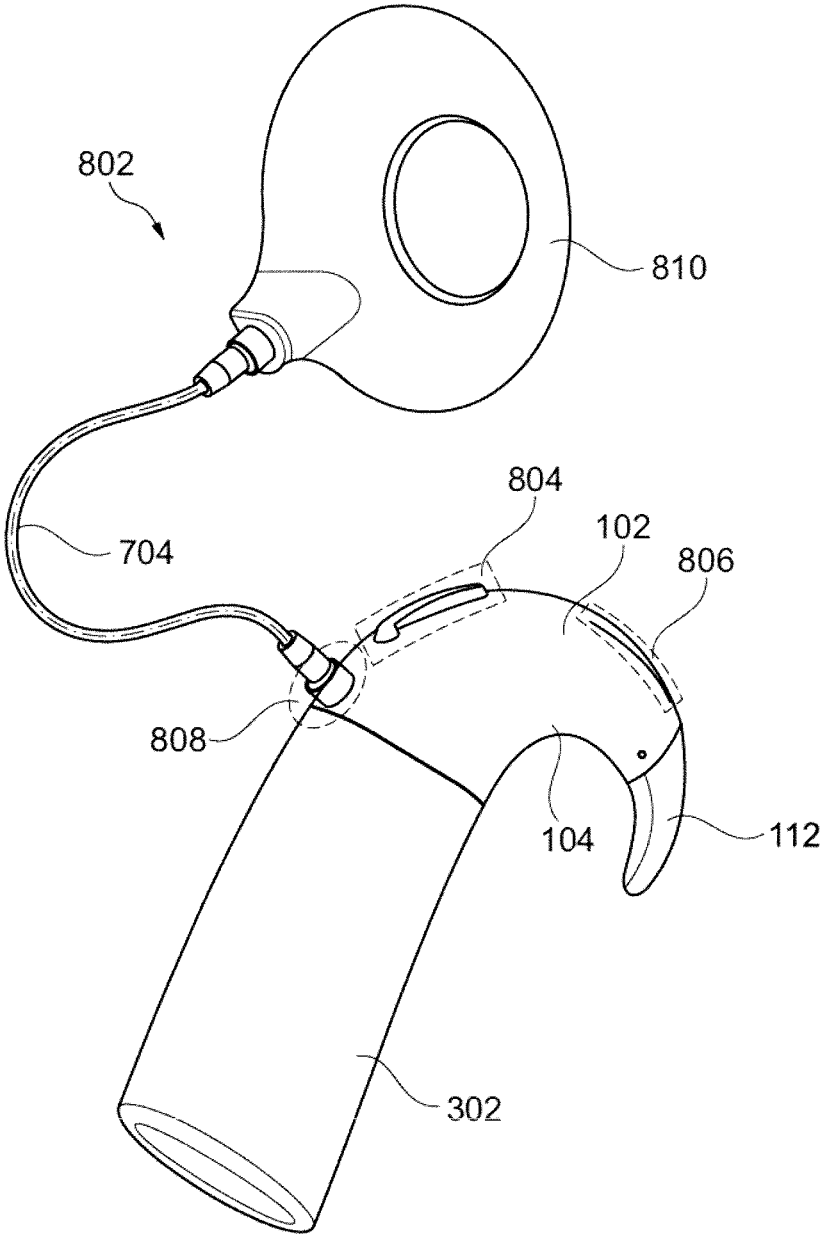
FIG. 8 illustrates a hearing aid comprising the housing according to an embodiment of the disclosure.

FIG. 8 illustrates a hearing aid comprising the housing according to an embodiment of the disclosure.

According to an embodiment, the BTE hearing aid unit 102 is a sound processor of a hearing aid 802 such as a cochlear implant system. According to another embodiment, a hearing aid 802 includes the hearing aid unit 102 described hereinabove in one or more embodiments is included. The hearing aid may include one of a cochlear implant.

Figure 1E:
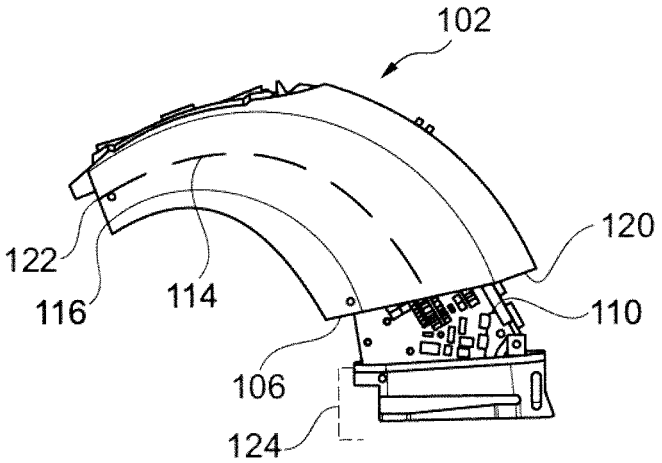
FIG. 1E illustrates the housing extending completely along a single curved axis and made of a single inseparable unit according to an embodiment of the disclosure.

In the illustrated embodiment, an external part of the cochlear implant system is shown. The figure illustrates the BTE hearing aid unit 102 comprising the housing 104 described above, and including the ear hook 112, push button assembly 804, For details see FIG. 6A-6B), microphone assembly 806 (for details see FIGS. 5A-5C), plug port assembly 808 (for details see FIGS. 7A-7C). An attachment module 302 (in this case a detachable battery) is shown to be attached with the BTE hearing aid unit 102 (for details, see FIGS. 3, and 4A-4B). A cable 704 is shown to be connected to the BTE hearing aid unit 102 at one end and on the other end, the cable 704 is connected to an antenna 810 that is adapted to inductively transmit, to the implantable part, the processed signal received from the electronic module (FIG. 1E, 110). The implantable part utilizes the signal received from the antenna to generate a number of stimulation pulses that are delivered to a number of electrodes, which are implantable in different locations of the cochlea allowing a stimulation of different frequencies of the audible range.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method are not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

The invention claimed is:

1. A behind-the-ear (BTE) hearing aid unit comprising a housing comprising a hollow inner section defined by an enclosed wall surface made of a single inseparable unit;

an electronic module; and an ear hook that is permanently or detachably attached to the housing; wherein the housing extends completely along a single curved axis running along the enclosed wall surface from a first end of the housing comprising the ear hook and a second end of the housing opposite to the ear hook, the housing comprises an inlet opening at the second end, the inlet opening being adapted to receive the electronic module in the hollow inner section and the electronic module is adapted to move from the inlet opening along the single curved axis, and the BTE hearing aid unit further comprises a cover not operably detachable from the housing, the cover being adapted to sealably close the hollow inner section at the second end, the cover comprising:

a first set of connectors adapted to establish electrical connection with the electronic module with one end of the first set of connectors being accessible from outside the hollow inner section, and a sliding guide rail configured to receive an attachable module comprising a second set of connectors, a portion of the attachable module being adapted to run along the guide rail to establish a mechanical connection between the housing and the attachable module and an electrical connection between the one end of the first set of connectors and second set of connectors, wherein the attachable module may include a battery compartment or a FM receiver.

2. The BTE hearing aid unit according to claim 1, wherein the single curved axis comprises a rotational axis defined by an arc selected from a group comprising a circular arc, substantially circular arc and parabolic arc.

3. The BTE hearing aid unit according to claim 1, further comprising a closing structure at the first end of the housing, the closing structure being part of the single inseparable unit.

4. The BTE hearing aid unit according to claim 1, wherein the closing structure or ear hook comprises a protruded part and another of the closing structure or ear hook comprises a receiving section, the protruded part and the receiving section being configured to couple with each other such that the ear hook and the housing is immovable in lateral directions relative to each other.

5. The BTE hearing aid unit according to claim 1, wherein the coupling of the protruded part and the receiving section are configured to align a through-going hole of the ear hook and a through-going hole of the housing such that the aligned through-going holes are configured to receive an attachment unit to immovably attach the detachably attached ear hook to the housing.

6. The BTE hearing aid unit according to claim 1, further comprising a microphone inlet cover adapted to attach to the housing to form a continuous concave shaped outer surface with the housing, the microphone inlet cover in cooperation with a housing exterior surface is adapted to form sound inlet channel adapted to allow ambient sound to travel from an entry of the sound inlet channel to an inlet port of a microphone that is comprised within the hollow inner section.

7. The BTE hearing aid unit according to claim 1, further comprising an alignment pin comprising a first end configured to be received within a receiving hole across the housing and comprised at a chassis holding the microphone, the chassis being positioned within the housing and the alignment pin being adapted to align the microphone with respect to an inlet and housing.

8. The BTE hearing aid unit according to claim 1, further comprising an inlet aligned to the inlet port of the microphone, the inlet being attached to the housing with a sealing material interposed between the inlet and side surface of the housing.

9. The BTE hearing aid unit according to claim 1, wherein the sound inlet channel comprises a volumetric chamber at least directly above the microphone, the dimensions of the volumetric chamber being adapted to bring pressure and/ or flow velocity of air flowing within the volumetric chamber substantially close to zero.

10. The BTE hearing aid unit according to claim 1, wherein the volumetric chamber is defined by a cut out section at the inner surface of the microphone inlet cover that is adapted to be at least directly above the microphone, the cut out section in combination with the sound inlet channel that is at least directly above the microphone is substantially larger than cross sectional area of rest of the sound inlet channel.

11. The BTE hearing aid unit according to claim 1, wherein the housing exterior surface comprises a push button slot comprising at least one slot to receive at least one push actuator and a fixing means slot; and the at least one push actuator is adapted to be fixedly positioned within the at least one slot with a sealing material interposed between the push actuator and side surface of the push button slot.

12. The BTE hearing aid unit according to claim 1, further comprising a push button cover adapted to cover the at least one push actuator; and a fixing means adapted to pass through the push button cover and to be received within the fixing means slot in order to attach the push button cover with the housing.

13. The BTE hearing aid unit according to claim 1, further comprising a plug port across the housing, the plug port being adapted to receive a cable into the housing and provide the cable access to a connector socket that is adapted to provide electrical connection between the electronic module and cable, wherein the connector socket is positioned within the housing such that the connector socket is along same longitudinal axis as a multi-connector positioned within the housing, the multi-connector is adapted to provide electrical connection between the electronic module and the attachment module.

14. A hearing aid comprising the hearing aid unit defined by claim 1.

15. The BTE hearing aid unit according to claim 2, further comprising a closing structure at the first end of the housing, the closing structure being part of the single inseparable unit.

16. The BTE hearing aid unit according to claim 2, wherein the closing structure or ear hook comprises a protruded part and another of the closing structure or ear hook comprises a receiving section, the protruded part and the receiving section being configured to couple with each other such that the ear hook and the housing is immovable in lateral directions relative to each other.

17. The BTE hearing aid unit according to claim 3, wherein the closing structure or ear hook comprises a protruded part and another of the closing structure or ear hook comprises a receiving section, the protruded part and the receiving section being configured to couple with each other such that the ear hook and the housing is immovable in lateral directions relative to each other.

18. The BTE hearing aid unit according to claim 2, wherein the coupling of the protruded part and the receiving section are configured to align a through-going hole of the ear hook and a through-going hole of the housing such that the aligned through-going holes are configured to receive an attachment unit to immovably attach the detachably attached ear hook to the housing.

19. The BTE hearing aid unit according to claim 3, wherein the coupling of the protruded part and the receiving section are configured to align a through-going hole of the ear hook and a through-going hole of the housing such that the aligned through-going holes are configured to receive an attachment unit to immovably attach the detachably attached ear hook to the housing.

* * * * *